US011302263B2

(12) United States Patent
Song et al.

(10) Patent No.: US 11,302,263 B2
(45) Date of Patent: Apr. 12, 2022

(54) ORGANIC LIGHT EMITTING DISPLAY DEVICE AND COMPENSATION METHOD THEREFOR

(71) Applicant: LG Display Co., Ltd., Seoul (KR)

(72) Inventors: Ji-Hee Song, Seoul (KR); Chul-Kwon Lee, Gimpo-si (KR); Ho-Chul Lee, Seoul (KR); Se-Ho Lim, Seongnam-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/118,003

(22) Filed: Dec. 10, 2020

(65) Prior Publication Data

US 2021/0201820 A1 Jul. 1, 2021

(30) Foreign Application Priority Data

Dec. 27, 2019 (KR) ..... 10-2019-0176435

(51) Int. Cl.
*G09G 3/3275* (2016.01)
*G09G 3/3266* (2016.01)

(52) U.S. Cl.
CPC ..... *G09G 3/3275* (2013.01); *G09G 3/3266* (2013.01); *G09G 2310/08* (2013.01); *G09G 2320/043* (2013.01)

(58) Field of Classification Search
CPC ..... H04L 69/04; H03M 7/30; G06F 16/1744; G06F 2212/401
See application file for complete search history.

(56) References Cited

U.S. PATENT DOCUMENTS

2013/0208016 A1* 8/2013 Park ..... G09G 3/2096 345/690
2014/0132429 A1* 5/2014 Scoville ..... H03M 7/3079 341/87
2015/0243201 A1* 8/2015 Chung ..... G09G 3/3225 345/690
2019/0173490 A1* 6/2019 Lee ..... H03M 7/3066
2020/0007149 A1* 1/2020 Fenney ..... G06F 30/327
2020/0007150 A1* 1/2020 Lacey ..... H03M 7/3059
2020/0372858 A1* 11/2020 Mobasher ..... G09G 3/3208
2021/0056912 A1* 2/2021 Park ..... G09G 3/3275

FOREIGN PATENT DOCUMENTS

KR 10-1028161 B1 4/2011

* cited by examiner

*Primary Examiner* — Nitin Patel
*Assistant Examiner* — Amen W Bogale
(74) *Attorney, Agent, or Firm* — Seed IP Law Group LLP

(57) ABSTRACT

The present disclosure relates to an organic light emitting display device. The device includes, among others, a controller including a data compensator configured to accumulate stress data applied to organic light emitting diodes (OLEDs) on the basis of input image data, to generate accumulated stress data under a condition for recovery of accumulated loss in a loss region, to compress and restore the accumulated stress data in a lossless manner and a loss manner to determine a compensated value and to output the compensated value. Accordingly, it is possible to estimate previous loss data on the basis of new image data to be currently accumulated, recover loss and accumulate data to prevent accumulation of loss and efficiently compensate for afterimage due to deterioration of OLEDs to extend the period of use.

12 Claims, 7 Drawing Sheets

ORGANIC LIGHT EMITTING DISPLAY DEVICE AND COMPENSATION METHOD THEREFOR

BACKGROUND

Technical Field

The present disclosure relates to an organic light emitting display device and a compensation method therefor, and more specifically, to an organic light emitting display device capable of estimating and recovering previous loss on the basis of new image data to be currently accumulated to extend the life of the display device.

Description of the Related Art

Recently, various flat panel display devices capable of reducing the weight and volume of a cathode ray tube, which are demerits of the cathode ray tube, have been developed. Flat panel display devices include a liquid crystal display device, a field emission display device, a plasma display panel, an organic light emitting display device, etc.

Among flat panel display devices, the organic light emitting display device displays images using organic light emitting diodes (OLEDs) that generate light according to recombination of electrons and holes. This organic light emitting display device has the merits of a rapid response speed and operation with low power consumption.

The organic light emitting display device includes a plurality of pixels disposed at intersections of scan lines and data lines. Each pixel includes an OLED that emits light with a luminance corresponding to a data signal and thus a pixel part displays an image.

However, the OLED deteriorates over time in response to an emission time and luminance (e.g., current quantity), and thus emission efficiency thereof decreases. When the emission efficiency of the OLED decreases in this manner, luminance decrease also occurs. Particularly, when pixels have different luminance decrease amounts, afterimage occurs, causing picture quality deterioration. Accordingly, it is necessary to appropriately compensate for deterioration of pixels in response to an accumulated light emission amount of each pixel to improve picture quality.

Further, loss generated when data for deterioration compensation is accumulated and compressed is also accumulated. Compensation performance may deteriorate due to such compression loss accumulation to generate afterimage.

BRIEF SUMMARY

The present disclosure provides an organic light emitting display device and a compensation method therefor which can efficiently compensate for imaging sticking due to deterioration of OLEDs to extend the period of use.

Further, the present disclosure provides an organic light emitting display device and a compensation method therefor which can estimate previous loss data on the basis of new image data to be currently accumulated to restore accumulated loss data.

In addition, the present disclosure provides an organic light emitting display device and a compensation method therefor which can prevent accumulation of loss by recovering loss and accumulating data.

In this regard, in one or more embodiments of the present disclosure, an organic light emitting display device includes: a display panel including a plurality of pixels to display an image; a data driver for applying a data signal to the display panel through a plurality of data lines; a scan driver for sequentially applying scan signals to the display panel through a plurality of scan lines; and a controller including a data compensator for accumulating stress data applied to organic light emitting diodes (OLEDs) on the basis of input image data, generating accumulated stress data under a condition for recovery of accumulated loss in a loss region, compressing and restoring the accumulated stress data in a lossless manner and a lossy manner to determine a compensation value and outputting the compensated value, and a timing controller for controlling a driving timing of the data driver and the scan driver.

In the organic light emitting display device according to the present disclosure, the data compensator may include: a conversion unit for mapping gradation values included in the input image data to a predetermined mapping table to convert the gradation values into stress data; a loss recovery unit for receiving the stress data from the conversion unit and generating accumulated stress data by reflecting loss in most significant bits (MSBs) of previous accumulated data when the condition for recovery of accumulated loss in the loss region is generated; and a compensation determination unit for receiving the accumulated stress data from the loss recovery unit and calculating compensated data on the basis of the stress data.

The stress data in the organic light emitting display device according to the present disclosure may represent a degree of deterioration of the OLEDs.

The accumulated stress data in the organic light emitting display device according to the present disclosure may have a size of 32 bits.

In the organic light emitting display device according to the present disclosure, the loss recovery unit may include: a compression unit for compressing average data calculated by dividing the accumulated stress data by the number of accumulations; a storage unit for storing the compressed average stress data; and a restoration unit for restoring the compressed average stress data.

In the organic light emitting display device according to the present disclosure, the compression unit may determine whether the condition for recovery of accumulated loss in the loss region is generated by checking or determining whether a value obtained by multiplying a current number of accumulations by a loss estimate value of current image data exceeds a quantization level.

In the organic light emitting display device according to the present disclosure, the compensated value may be used to compensate for afterimage generated due to deterioration of the OLEDs on the basis of the input image data and the accumulated stress data transmitted from the restoration unit.

A compensation method for an organic light emitting display device according to the present disclosure may include: converting input image data into stress data applied to organic light emitting diodes (OLEDs); accumulating the stress data under a condition for recovery of accumulated loss in a loss region and compressing and restoring the accumulated stress data in a lossless manner and a lossy manner; determining a compensation value on the basis of the restored accumulated stress data; and controlling display drivers using the determined compensated value.

The compensation method for an organic light emitting display device according to the present disclosure may include the steps of: receiving previously accumulated stress data; receiving current input image data; estimating previous loss data from the current input image data; determining whether loss recovery is required; reflecting loss in most significant bits (MSBs) of the previously accumulated stress data when loss recovery is required; compressing current accumulated stress data; storing the compressed accumulated stress data; and restoring the compressed accumulated stress data.

In the compensation method for an organic light emitting display device according to the present disclosure, the determining of whether loss recovery checks (or determines) whether a value obtained by multiplying a current number of accumulations by a loss estimate value of current image data exceeds a quantization level.

In the compensation method for an organic light emitting display device according to the present disclosure, the compensated value may be used to compensate for afterimage generated due to deterioration of the OLEDs on the basis of the input image data and the restored accumulated stress data.

The organic light emitting display device and the compensation method therefor according to the present disclosure have effects of preventing accumulation of loss by estimating previous loss data on the basis of new image data to be currently accumulated, recovering loss and accumulating data, and extending the period of use by efficiently compensating for afterimage due to deterioration of OLEDs.

DETAILED DESCRIPTION

Figure 1:
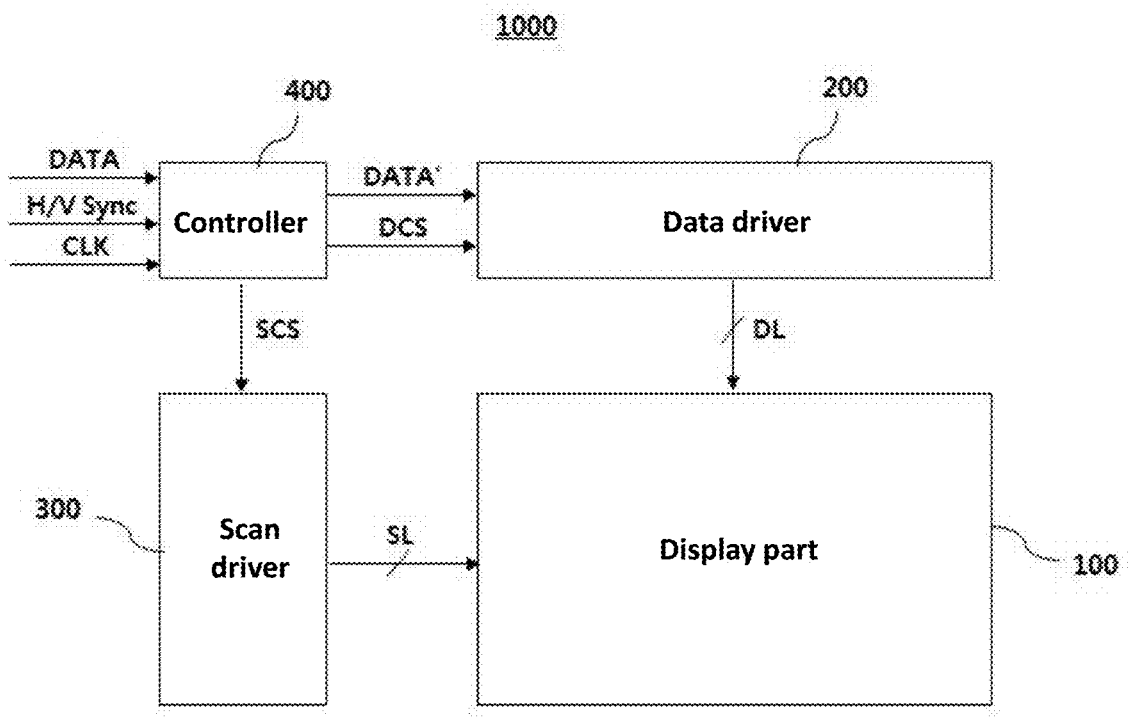
FIG. 1 is a block diagram schematically showing an organic light emitting display device according to an embodiment of the present disclosure.

For embodiments of the present disclosure disclosed in the description, specific structural and functional descriptions are exemplified for the purpose of describing embodiments of the present disclosure, and embodiments of the present disclosure can be implemented in various forms and are not to be considered as a limitation of the disclosure.

The present disclosure can be modified in various manners and have various forms and specific embodiments will be described in detail with reference to the drawings. However, the disclosure should not be construed as limited to the embodiments set forth herein, but on the contrary, the disclosure is to cover all modifications, equivalents, and alternatives falling within the spirit and scope of the embodiments.

While terms, such as "first," "second," etc., may be used to describe various components, such components must not be limited by the above terms. The above terms are used only to distinguish one component from another. For example, a first component may be referred to as a second component and the second component may be referred to as the first component without departing from the scope of the present disclosure.

When an element is "coupled" or "connected" to another element, it should be understood that a third element may be present between the two elements although the element may be directly coupled or connected to the other element. When an element is "directly coupled" or "directly connected" to another element, it should be understood that no element is present between the two elements. Other representations for describing a relationship between elements, that is, "between," "immediately between," "in proximity to," "in direct proximity to" and the like should be interpreted in the same manner.

The terms used in the specification of the present disclosure are merely used in order to describe particular embodiments, and are not intended to limit the scope of the present disclosure. An element described in the singular form is intended to include a plurality of elements unless the context clearly indicates otherwise. In the specification of the present disclosure, it will be further understood that the terms "comprise" and "include" specify the presence of stated features, integers, steps, operations, elements, components, and/or combinations thereof, but do not preclude the presence or addition of one or more other features, integers, steps, operations, elements, components, and/or combinations thereof.

Unless otherwise defined, all terms including technical and scientific terms used herein have the same meaning as commonly understood by one of ordinary skill in the art to which the embodiments pertain. It will be further understood that terms, such as those defined in commonly used dictionaries, should be interpreted as having a meaning that is consistent with their meaning in the context of the relevant art and should not be interpreted in an idealized or overly formal sense unless expressly so defined herein.

Meanwhile, when a certain embodiment can be implemented in a different manner, a function or an operation specified in a specific block may be performed in a different sequence from that specified in a flowchart. For example, two consecutive blocks may be simultaneously executed or reversely executed according to related function or operation.

Hereinafter, a display device and a compensation method therefor according to the present disclosure will be described with reference to the attached drawings.

FIG. 1 is a block diagram showing an organic light emitting display device according to embodiments of the present disclosure. Referring to FIG. 1, the organic light emitting display device 1000 may include a display panel 100, a data driver 200, a scan driver 300, and a controller 400.

The display panel 100 includes a plurality of pixels arranged therein, and each pixel includes an OLED that emits light in response to flow of driving current according to a data signal DATA supplied from the data driver 200. The display panel 100 can display an image by receiving a data signal from the data driver 200 through data lines DL and receiving a scan signal from the scan driver 300 through scan lines SL.

The data driver 200 can apply a data signal to the display panel 100 through the data lines DL. The data signal can be applied to each pixel included in the display panel 100 to control the operation of a driving transistor. The scan driver 300 can apply a scan signal to the display panel 100 through the scan lines SL. The scan signal can be applied to each pixel included in the display panel 100 to control the operation of a switching transistor.

The controller 400 may include a data compensator 410 and a timing controller 420. The data compensator 410 can estimate a degree of deterioration of OLEDs included in the pixels of the display panel 100 on the basis of input data and output compensated data for compensating for luminance reduced due to deterioration of the OLEDs. The timing controller 420 may be connected to the data driver 200 and the scan driver 300 and can control a time at which a data signal and a scan signal are supplied from the data driver 200 and the scan driver 300 to the display panel 100.

Although not shown in FIG. 1, the organic light emitting display device 1000 may include an emission control driver which controls light emission of the pixels and a power supply which supplies power to the pixels.

Figure 2:
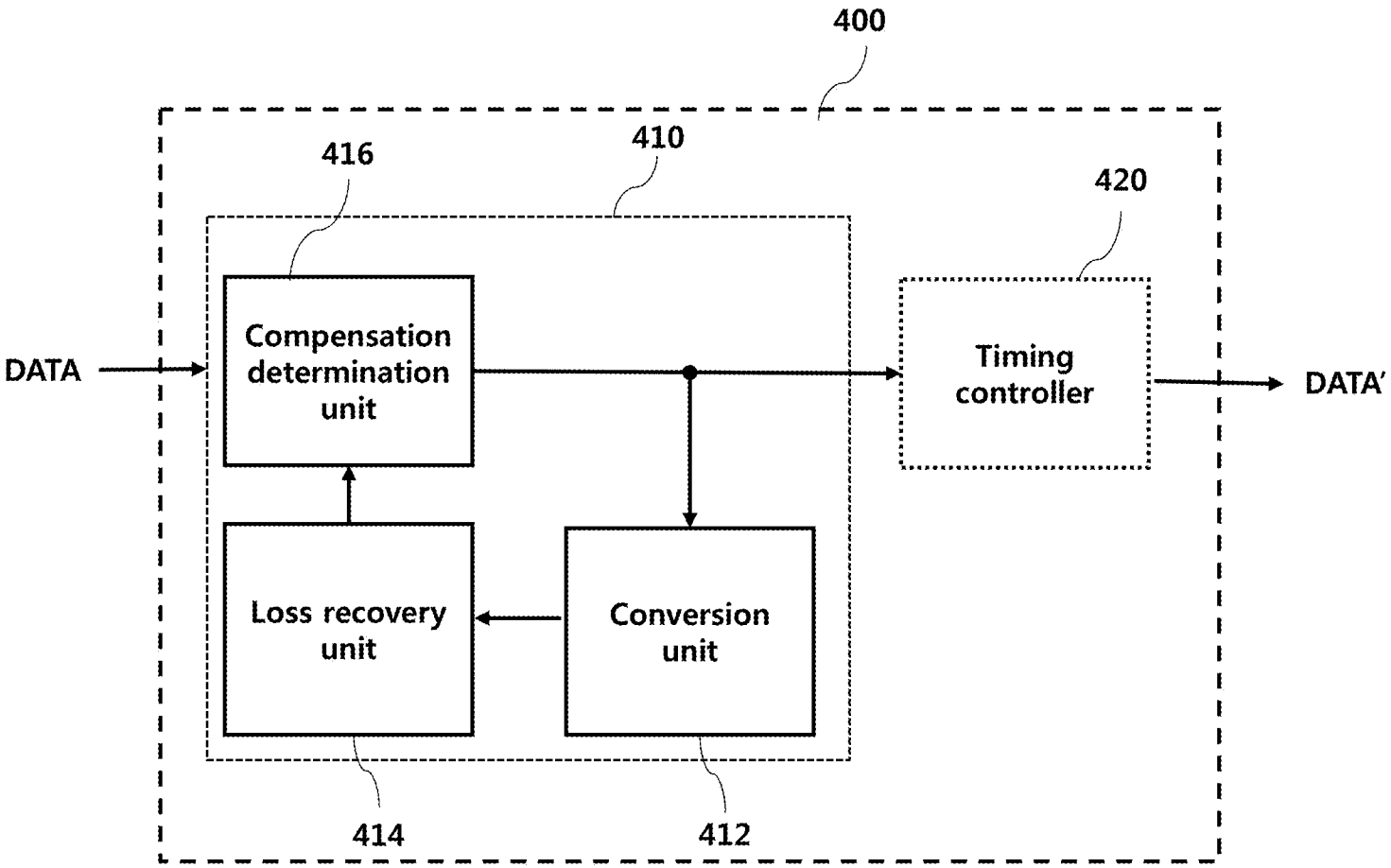
FIG. 2 is a block diagram showing a controller included in the organic light emitting display device shown in FIG. 1.
Figure 3:
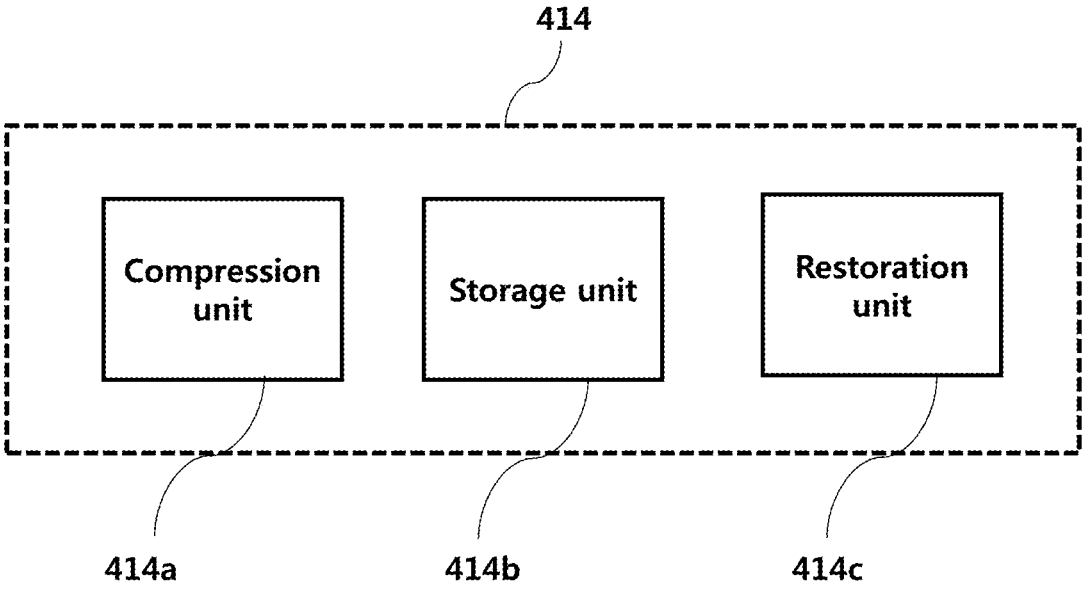
FIG. 3 is a block diagram showing a loss recovery unit included in a data compensator shown in FIG. 2.
Figure 4:
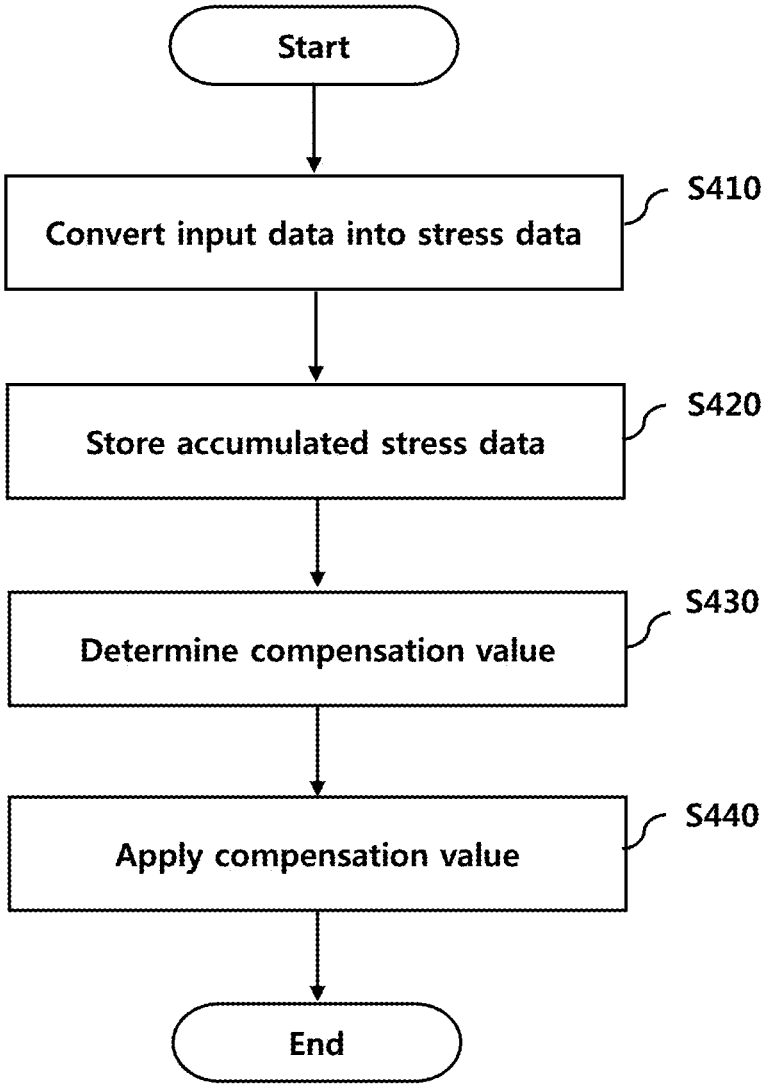
FIG. 4 is a flowchart showing a processing procedure of a compensation method for an organic light emitting display device according to the present disclosure.

FIG. 2 is a block diagram showing the controller included in the organic light emitting display device 1000 shown in FIG. 1, FIG. 3 is a block diagram showing a loss recovery unit included in the data compensator shown in FIG. 2, and FIG. 4 is a flowchart showing a processing procedure of a compensation method for an organic light emitting display device according to the present disclosure.

Referring to FIG. 2, the controller 400 may include the data compensator 410 and the timing controller 420.

The timing controller 420 can generate a timing signal for driving the display panel 100 on the basis of a vertical synchronization signal Vsync, a horizontal synchronization signal Hsync and a clock signal CLK. For example, the timing signal may be a scan control signal SCS and a data control signal DCS. The data compensator 410 can correct input data into compensated data and output the compensated data, and an output timing of the compensated data can be controlled by the timing controller 420 and the compensated data with the controlled output timing can be transmitted to the data driver 200. Specifically, the data compensator 410 may include a conversion circuit 412, a loss recovery circuit 414, and a compensation determination circuitry 416, as shown in FIG. 2. A conversion circuit 412 (which may be referred to herein as a conversion unit 412) may include any electrical circuitry, features, components, an assembly of electronic components or the like configured to perform the various operations of the conversion unit features as described herein. In some embodiments, the conversion unit 412 may be included in or otherwise implemented by processing circuitry such as a microprocessor, microcontroller, integrated circuit, chip, microchip or the like. The same is applied to a loss recovery unit 414, a compensation determination unit 416, or any other component labeled "unit" in the present disclosure.

The conversion unit 412 can convert compensated data into stress data. Prior to conversion of the compensated data into the stress data, the conversion unit 412 can change the compensated data input as 6-bit or 8-bit gradation data into a gradation value. For example, 6-bit gradation data may have a gradation value in the range of 0 to 63 and 8-bit gradation data may have a gradation value in the range of 0 to 255. In nonlinearly input compensated data, a larger gradation value of stress data can be obtained when the compensated data has a larger gradation value. A maximum input data value may be a maximum gradation value of input data. A gradation value of maximum input data may depend on the number of bits of input data. In an embodiment, maximum input data of an organic light emitting display device having 6-bit input data may be 111111 and a gradation value of the maximum input data may be 63. In another embodiment, maximum input data of an organic light emitting display device having 8-bit input data may be 11111111 and a gradation value of the maximum input data may be 255.

A stress data value can indicate stress applied to an OLED, that is, a degree of deterioration of the OLED. As data with higher gradation is input to an OLED, deterioration of the OLED can be accelerated. Accordingly, a stress data value may increase as a compensated data value increases. A stress data value can be transmitted to the loss recovery unit 414 (S410).

As a gradation value of input data increases, a stress data gradation value may increase. The loss recovery unit 414 includes a compression unit 414*a*, a storage unit (e.g., storage circuitry, storage device, memory, or the like) 414*b* and a restoration unit 414*c*. Stress data converted by the conversion unit 412 can be transmitted to the compression unit 414*a*. To accumulate and store stress data, a storage device with large capacity needs to be provided. To reduce the capacity of the storage device, the compression unit 414*a* is provided and compressed stress data may be accumulated and stored in the storage unit 414*b*. The stress data stored in the storage unit 414*b* may be decompressed through the restoration unit 414*c* and output.

The compensation determination unit 416 can calculate compensated data on the basis of stress data and input data transmitted from the loss recovery unit 414. The compensation determination unit 416 can change input data transmitted from the outside into gradation values of the input data. When gradation values of stored stress data are SD1, SD2, SD3, . . . , SDn, accumulated stress data λn of n-th stress data values can be obtained. For example, the accumulated stress data λn may be the sum of SD1 to SDn as represented by Equation 1.

$$\lambda n = \Sigma_{i=1}^{n} SDi \qquad \text{[Equation 1]}$$

Although a method of obtaining the accumulated stress data λn has been described with reference to Equation 1, the method of obtaining the accumulated stress data is not limited thereto (S420).

Figure 5:
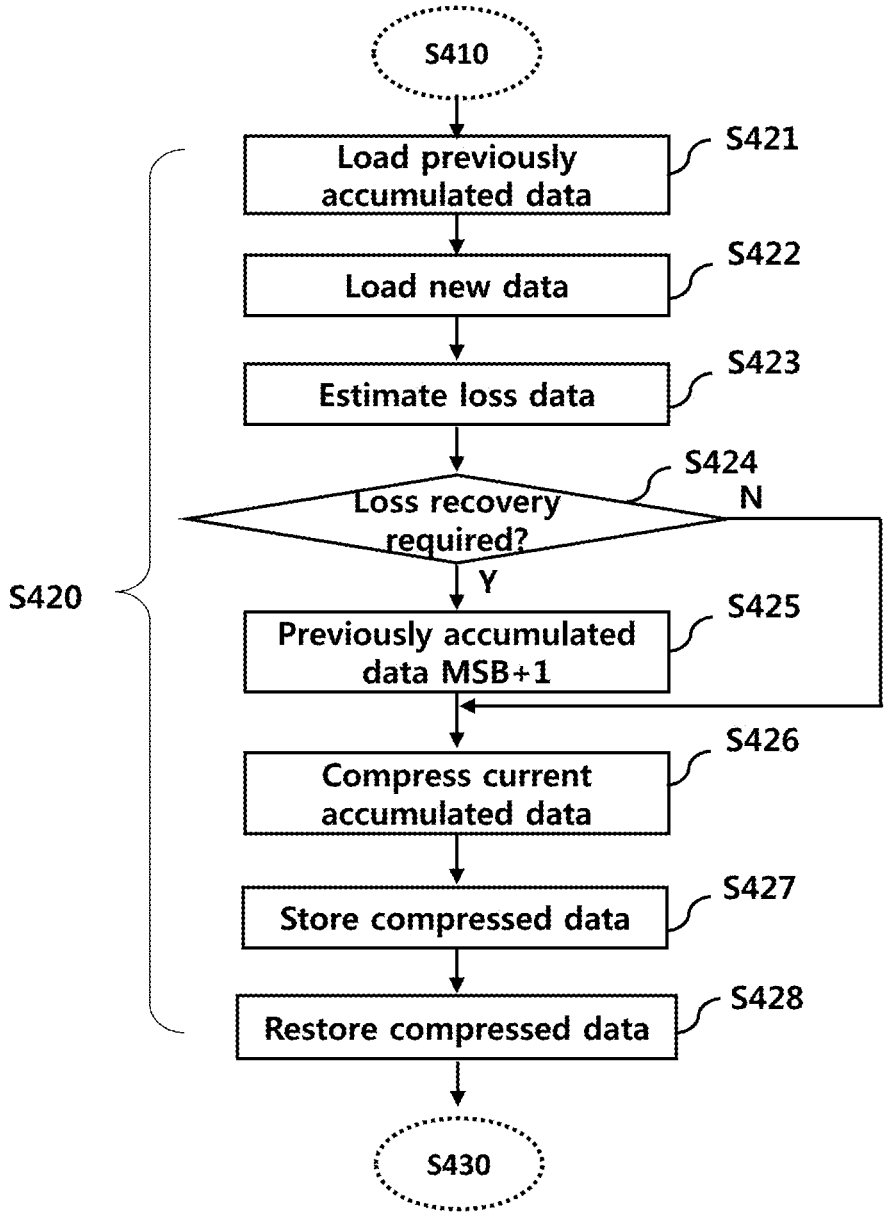
FIG. 5 is a flowchart showing a stress data storage process.
Figure 6:
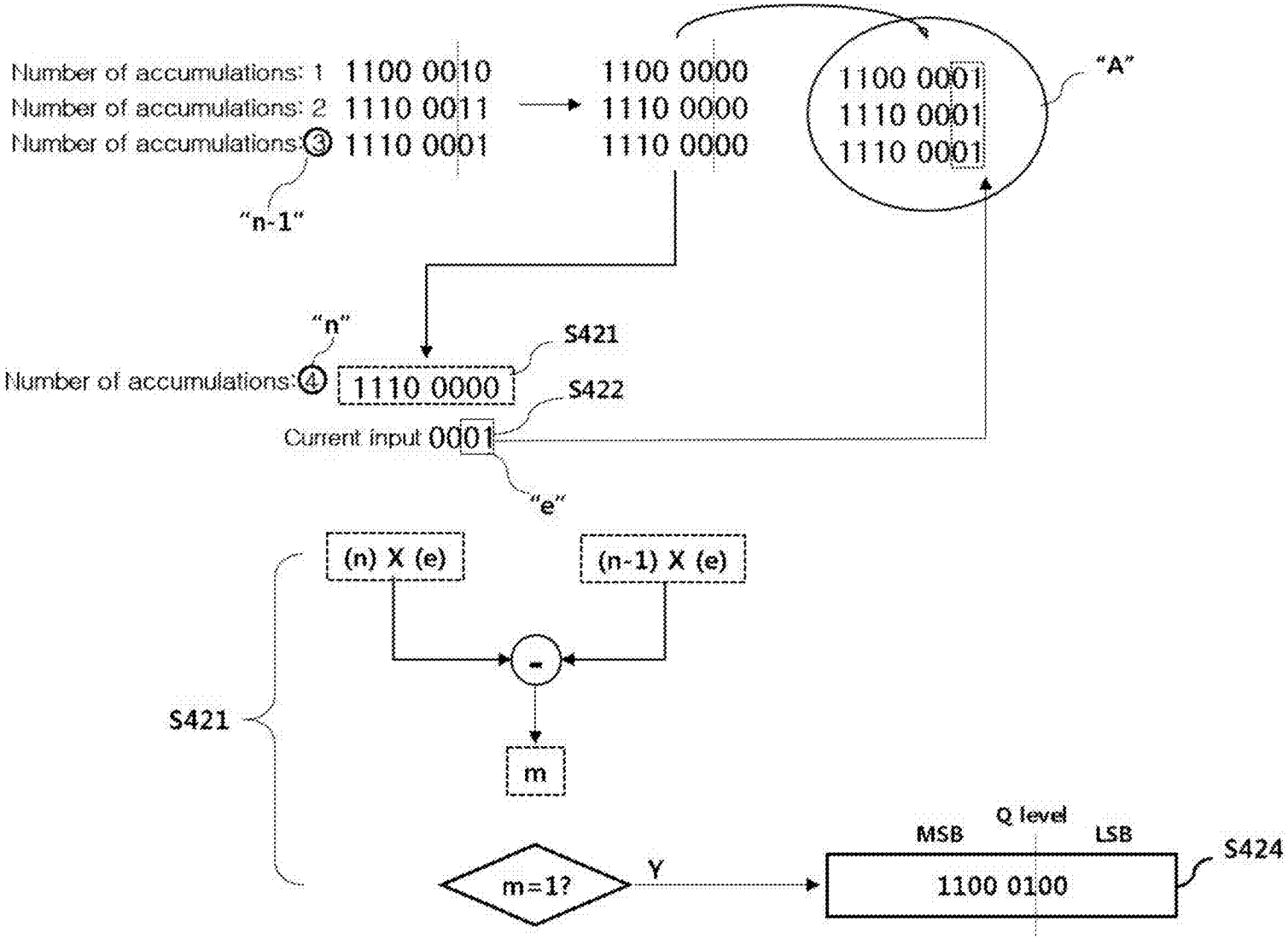
FIG. 6 is a diagram illustrating loss during a stress data accumulation process.

As described above, a method of accumulating stress data is performed as shown in FIGS. 5 and 6. Since a process of accumulating stress data may be performed for all pixels of a display panel for each frame, an arbitrary pixel is targeted.

Previously accumulated stress data is read. Here, the read accumulated stress data refers to a restored value of average data calculated by dividing stress data accumulated multiple times by the number of accumulations. If initially input image data is received, accumulated stress data is not present (S421).

Stress accumulation starts as current input image data is received. Simultaneously, loss starts to occur on the basis of a quantization level while stress data is divided into most significant bits (MSBs) and least significant bits (LSBs) (S422).

Loss data is estimated on the basis of current input image data. An example in which current input image data is fourth input image data will be described as shown in FIG. 6. Here, a gradation value for the input image data is an 8-bit value, for example, 6 bits can be defined as MSBs and the remaining 2 bits can be defined as LSBs on the basis of the quantization level.

For example, when first stress data is input as "1100 0010," loss is generated once upon occurrence of first accumulation. That is, one or more LSBs can be abandoned. The accumulated stress data value becomes "1100 0000" as 2 bits among LSBs are lost.

When "1110 0011" is received as second input image data and second accumulation occurs, 2 bits of "11" among LSBs are lost.

When "1110 0001" is received as third input image data and third accumulation occurs, 2 bits of "01" among LSBs are lost. Here, an accumulated stress data value restored by being accumulated as the average value becomes "1110 0000," 2 bits of "01" among LSBs are estimated as a loss value (S423). It is determined whether loss recovery with respect to the estimated loss value is required. When the number of accumulations is "n" and the loss estimate value is "e," a product of the two values is calculated. It is determined whether the value of "3*01" exceeds 2 bits corresponding to LSBs. Since "3" corresponds to "11," it does not correspond to a loss recovery condition.

When "1110 0001" is input as fourth input image data, 2 bits of "01" among LSBs are estimated as a loss value. That is, it is estimated that "01" in "1100 0001," "1110 0001" and "1110 0001" is lost, as represented by "A." It is determined whether loss recovery for currently input stress data is required on the basis of a loss estimate value.

Here, it is determined whether loss recovery is required on the basis of a value obtained by multiplying the number of losses by a value estimated as a lost value. It is determined whether the value of "4*01" exceeds 2 bits corresponding to LSBs. The resultant value "4" corresponds to "100" greater than 2 bits of "11." This value exceeds 2 bits corresponding to a quantization reference level and thus corresponds to the loss recovery condition.

As shown, when the number of accumulations is "n," a loss estimate value is "e," and a difference between "n*e" and "(n−1)*e" is "m," the loss recovery condition is determined by checking (or determining) whether "m" is "1." That is, if "n*e" is "100" and "(n−1)*e" is "011," third bits higher than 2 bits corresponding to the quantization level (Q level) have "1" and "0." It is determined whether a difference between the two values is "1" and it is determined that the recovery condition is satisfied if the difference is "1." Accumulated loss up to the present point in time is loaded to a lossless region if "n*e" is "100" and accumulated loss immediately before the present point in time is not loaded to the lossless region if "(n−1)*e" is "011" (S424).

When it is determined that loss recovery is required, "1" is added to the last bit of MSBs of previously accumulated data. That is, lost data needs to be restored and accumulated to the lossless region as "1110 0100."

A stress data being compressed is divided into a lossless area and a lossy area based on the quantization level. The data in the loss area is compressed in the form of loss without storing the data. Based on the accumulated data, the MSB is used as the reference for generating the actual panel compensation value. The size of MSB is 8 bits which occupy among 32 bits of the accumulated stress data.

A lossless manner of compressing and then restoring the accumulated stress data is therefore carried out by conducting the following steps. The data being stored in the memory using entropy coding method are data in lossless region and the information for the compression as like quantization level. In restoring process, all the memory area of LSB are stored with 0 based on the quantization level.

A lossy manner of compressing and restoring the accumulated stress data is therefore carried out by conducting the following steps. The data being stored in the memory using entropy coding method are data in lossless region and the information for the compression as like quantization level. In restoring process, upper MSB bit for each data is stored as 1 bit or more according to the result of calculation. The added bit is stored and the rest of LSB are stored with 0 based on the quantization level.

After the above two compression and restorations are carried out, the compensation value is determined from this information as follows. By restoring the loss and accumulating data, it is possible to compensate the loss from accumulating. After restoring, the data in MSB of 32 bits is used as the reference for generating the actual panel compensation value. On the assumption that previous loss data is the same as the current loss data, the previously accumulated loss is predicted from the current data.

As described in the above example, loss recovery is not required at the time of the third accumulation and thus current input image data is accumulated on previously accumulated stress data. Since loss recovery is required at the fourth accumulation, accumulated stress data immediately before the present point in time, MSB+"1," is added to current input image data to generate current accumulated stress data. Here, a loss start time is updated to a value corresponding to the current number of accumulations (S425).

The compression unit 414*a* divides the current accumulated stress data by the number of accumulations to compress average stress data (S426).

The compressed stress data is stored in the storage unit 414*b* such as a memory (S427).

The restoration unit 414*c* restores the compressed and stored stress data (S428).

Figure 7:
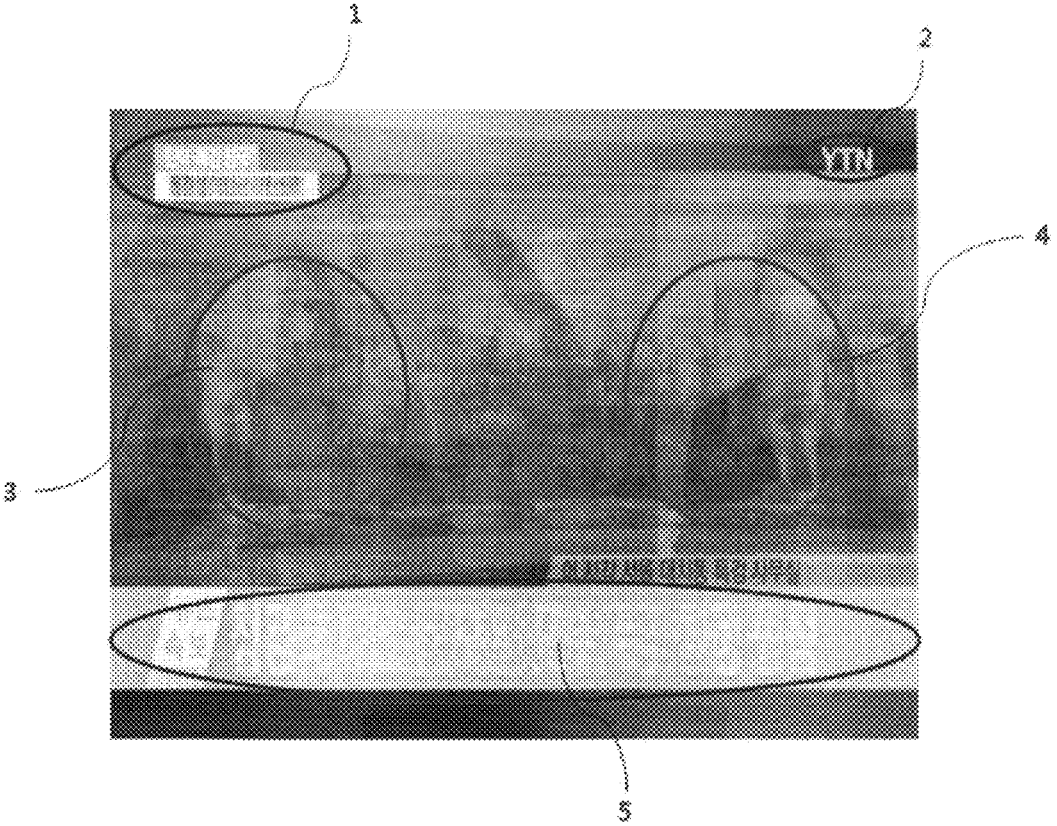
FIG. 7 is a diagram illustrating a loss recovery process according to the present disclosure.

FIG. 7 shows an example of a screen displayed through the display device. As shown, it is assumed that the screen includes a first logo region 1, a second logo region 2, a first general image display region 3, a second general image display region 4, and a caption region 5.

Table 1 shows differences between loss values before and after loss value recovery.

TABLE 1

| Region | First logo region | Second logo region | First general region | Second general region | Caption region |
|---|---|---|---|---|---|
| Loss before loss recovery | 1.76 | 1.82 | 2.68 | 1.93 | 12.42 |
| Loss after loss recovery | 1.02 | 1.75 | 2.07 | 1.75 | 3.27 |

Loss before loss recovery represents a difference between a 32-bit accumulated data value before compression and a 32-bit accumulated data value after compression. Loss after loss recovery represents a difference between a 32-bit accumulated data value before compression and a 32-bit accumulated data value after compression/loss recovery. As shown in Table 1, it can be ascertained that loss values decrease in each region.

The compensation method according to the present disclosure can be effective for a fixed-form region having insignificant variation over time.

As described above, the organic light emitting display device and the compensation method therefor according to the present disclosure can estimate previous loss data on the basis of new image data to be currently accumulated, recover loss and accumulate data to prevent accumulation of loss and efficiently compensate for afterimage due to deterioration of OLEDs to extend the period of use.

Although preferred embodiments of the present disclosure have been described above, it will be apparent to those skilled in the art that various modifications and variations can be made in the present disclosure without departing from the spirit or scope of the disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An organic light emitting display device, comprising:

a display panel including a plurality of pixels to display an image;

a data driver for applying a data signal to the display panel through a plurality of data lines;

a scan driver for sequentially applying scan signals to the display panel through a plurality of scan lines; and a controller including a data compensator and a timing controller, wherein the data compensator accumulates stress data applied to organic light emitting diodes (OLEDs) on the basis of input image data, generates the accumulated stress data under a condition for recovery of accumulated loss in a loss region, compresses and restores the accumulated stress data in a lossless manner and a lossy manner to determine a compensation value and outputs the compensated value, and the timing controller controls a driving timing of the data driver and the scan driver, wherein the data compensator generates accumulated stress data by reflecting loss in most significant bits of previous accumulated data when the condition for recovery of accumulated loss in the loss region is generated, and compresses average stress data calculated by dividing the accumulated stress data by a number of accumulations.

2. The organic light emitting display device of claim 1, wherein the data compensator comprises:

a conversion circuitry for mapping gradation values included in the input image data to a predetermined mapping table to convert the gradation values into stress data;

a loss recovery circuitry for receiving the stress data from the conversion circuitry and generating accumulated stress data by reflecting loss in MSBs of previous accumulated data when the condition for recovery of accumulated loss in the loss region is generated; and a compensation determination circuitry for receiving the accumulated stress data from the loss recovery circuitry and calculating compensated data on the basis of the stress data.

3. The organic light emitting display device of claim 2, wherein the stress data represents a degree of deterioration of the OLEDs.

4. The organic light emitting display device of claim 2, wherein the accumulated stress data has a size of 32 bits.

5. The organic light emitting display device of claim 2, wherein the loss recovery circuitry comprises:

a storage circuitry for storing the compressed average stress data; and a restoration circuitry for restoring the compressed average stress data.

6. The organic light emitting display device of claim 5, wherein the data compensator determines whether the condition for recovery of accumulated loss in the loss region is generated by determining whether a value obtained by multiplying a current number of accumulations by a loss estimate value of current image data exceeds a quantization level.

7. The organic light emitting display device of claim 5, wherein the compensated value is used to compensate for an afterimage generated due to deterioration of the OLEDs on the basis of the input image data and the accumulated stress data transmitted from the restoration circuitry.

8. A compensation method for an organic light emitting display device, comprising:

converting input image data into stress data applied to organic light emitting diodes (OLEDs);

accumulating the stress data under a condition for recovery of accumulated loss in a loss region;

compressing and restoring the accumulated stress data in a lossless manner and a lossy manner;

determining a compensation value on the basis of the restored accumulated stress data; and controlling display drivers using the determined compensation value, wherein accumulating the stress data under a condition for recovery of accumulated loss in a loss region includes:

reflecting loss in most significant bits (MSBs) of the previously accumulated stress data when loss recovery is required; and compressing average stress data calculated by dividing the accumulated stress data by a number of accumulations.

9. The compensation method of claim 8, wherein accumulating the stress data under a condition for recovery of accumulated loss in a loss region further includes:

receiving previously accumulated stress data;

receiving current input image data;

estimating previous loss data from the current input image data;

determining whether loss recovery is required;

storing the compressed accumulated stress data; and restoring the compressed accumulated stress data.

10. The compensation method of claim 9, wherein determining whether loss recovery is required includes:

determining whether a value obtained by multiplying a current number of accumulations by a loss estimate value of current image data exceeds a quantization level.

11. The compensation method of claim 9, wherein the compensated value is used to compensate for afterimage generated due to deterioration of the OLEDs on the basis of the input image data and the restored accumulated stress data.

12. The compensation method of claim 9, wherein the stress data represents a degree of deterioration of the OLEDs.

* * * * *